United States Patent [19]

Stamets et al.

[11] 4,346,667

[45] Aug. 31, 1982

[54] INSIDE POWDER STRIPING APPARATUS

[75] Inventors: Stanley L. Stamets, South Holland; Robert A. Winkless, Oak Lawn; Rafael J. Hernandez, Chicago; Joseph J. Merle, Oak Lawn; Robert D. Payne, Countryside, all of Ill.

[73] Assignee: The Continental Group, Inc., Stamford, Conn.

[21] Appl. No.: 218,324

[22] Filed: Dec. 19, 1980

[51] Int. Cl.[3] ..... B05B 5/02; B05C 7/02; B05C 19/00

[52] U.S. Cl. ..... 118/622; 118/308; 118/317; 118/DIG. 10

[58] Field of Search ..... 118/622, 301, 317, DIG. 10, 118/308; 427/197, 181

[56] References Cited

U.S. PATENT DOCUMENTS

| | | | |
|---|---|---|---|
| 3,526,027 | 9/1970 | Manuel et al. | 118/622 X |
| 4,098,226 | 7/1978 | Furter | 118/624 X |
| 4,158,071 | 6/1979 | Jordan et al. | 118/622 X |
| 4,212,266 | 7/1980 | Payne et al. | 118/317 X |
| 4,215,648 | 8/1980 | Stamets et al. | 118/308 X |
| 4,259,923 | 4/1981 | Breen | 118/308 X |

*Primary Examiner*—Evan K. Lawrence

*Attorney, Agent, or Firm*—Charles E. Brown

[57] ABSTRACT

This relates to a powder applicator for applying a coating stripe in powder form to inside seams of can bodies. The powder applicator is particularly adapted to be utilized in conjunction with welding apparatus for welding the side seams of can bodies and wherein the diameters of the can bodies are too small to permit the provision of the customary excess powder return duct. The powder applicator is located at the 12:00 o'clock position and thus the excess powder will not merely fall out of the applicator. Accordingly, there is provided a channel defined by a porous block having air or gas circulated therethrough and wherein the terminal end of the channel is closed by a deflector block which will deflect any excess powder out of the applicator into an overlying hood which is primarily intended to take away powder overspray which normally occurs between adjacent, but spaced, can bodies.

12 Claims, 8 Drawing Figures

HIGH VOLTAGE POWER

INSIDE POWDER STRIPING APPARATUS

This invention relates in general to new and useful improvements in the application of powder to form a coating for welded seams, and more particularly to a powder applicator for applying coating powder to the interior of can bodies over the welded side seams thereof wherein the side seams are located at the 12:00 o'clock position.

This invention constitutes an improvement of the side striping apparatus disclosed in our U.S. Pat. No. 4,215,648 granted Aug. 5, 1980. It differs from the powder applicator of that patent in that striping occurs at the 12:00 o'clock position as opposed to the 6:00 o'clock position, preventing material difficulties in powder fallout. Further, the powder applicator of this invention is particularly designed for small diameter can bodies, i.e. can bodies having diameters on the order of $2\frac{1}{8}$ inches and the like. The small diameter can bodies require that the associated supporting horn be of a like, but smaller, diameter, which side supporting horn does not provide adequate space for a customary return duct for returning excess powder.

In accordance with this invention, there is provided a powder applicator wherein the applicator is designed to make certain that substantially all powder directed into the apparatus is deposited on can bodies passing over the apparatus with that powder which may be excessive being removed from the applicator between adjacent can bodies into an external collection hood.

The powder applicator includes a porous block defining a channel which, together with brushes engaging the interior of a can body, defines the area in which powder being applied flows. The powder is initially directed toward the path of the can body side seam and, having been initially electrostatically charged, primarily adheres to the can body. A certain amount of the powder drops off of the can body into the channel where it is further electrostatically charged and, at the same time, is formed into a general cloud by air introduced into the channel through the porous block. Powder may flow longitudinally along the channel and that minimal amount of powder which reaches the far end of the channel is directed by a deflector vertically out of the channel and passes between adjacent can bodies into the collector hood thereby eliminating the necessity for a powder return duct within the horn.

At this time it is pointed out that there has been previously developed a powder applicator which supplies powder to side seams of can bodies at the 12:00 o'clock position. This prior powder applicator, however, relies solely upon charging pins within the channel of the charging apparatus for directing the powder toward the can body side seams and has no problem with respect to an excess powder return duct.

There have also been developed other powder applicators operable at the 12:00 o'clock position, but without sufficient efficiency. The patent to Furter U.S. Pat. No. 4,098,226, granted July 4, 1978, is an example of such a powder applicator.

With the above and other objects in view that will hereinafter appear, the nature of the invention will be more clearly understood by reference to the following detailed description, the appended claims, and the several views illustrated in the accompanying drawings.

IN THE DRAWINGS

Figures 1, 2, 3, 4, 5:
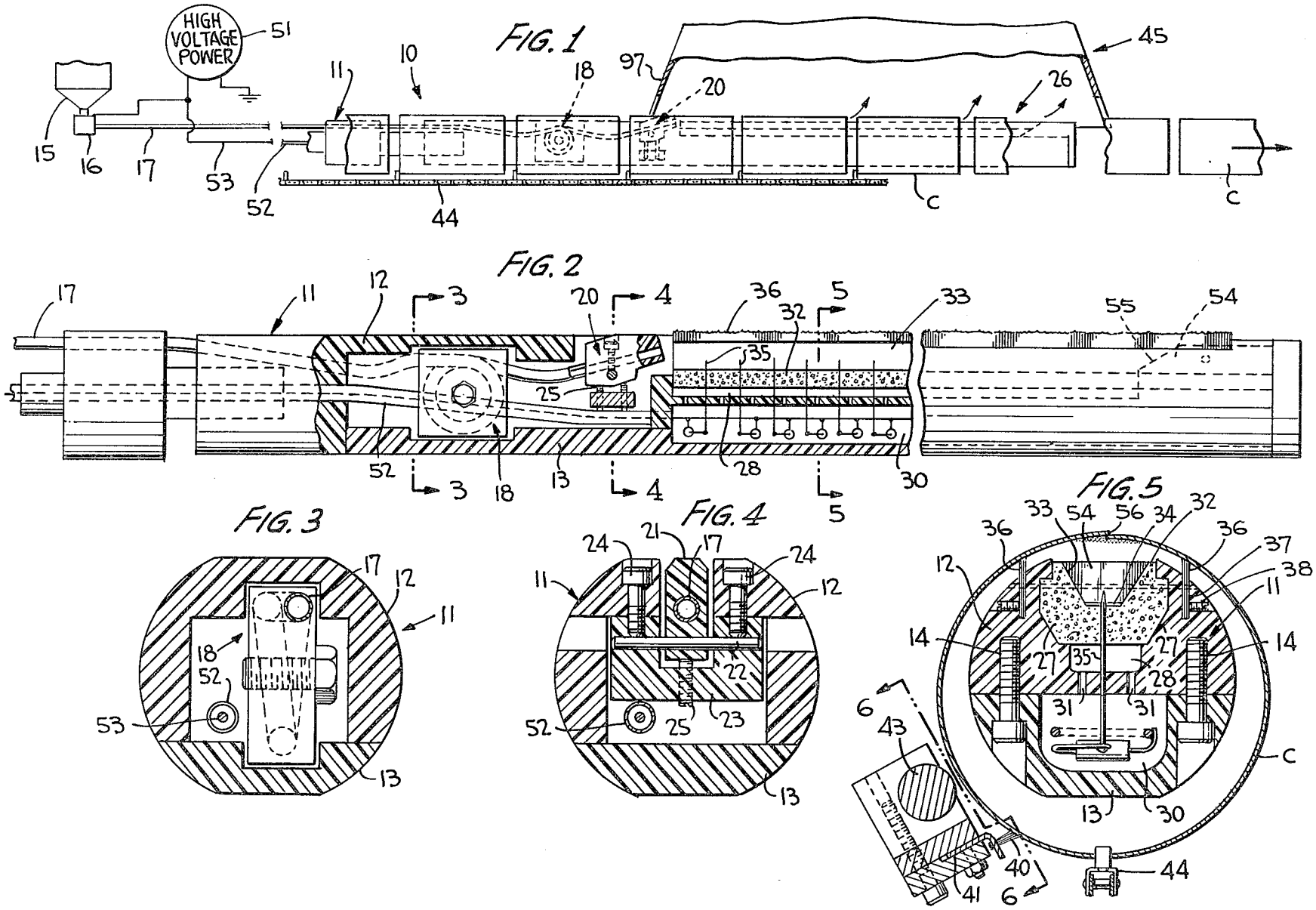
FIG. 1 is a side elevational view of the powder applicator with parts broken away and components thereof schematically shown.
FIG. 2 is an enlarged side elevational view of the supporting horn of the powder applicator with portions broken away and shown in section.
FIG. 3 is an enlarged transverse vertical sectional view taken generally along the line 3—3 of FIG. 2, and shows the mounting of a centrifuge.
FIG. 4 is an enlarged vertical sectional view taken generally along the line 4—4 of FIG. 2, and shows the adjustable mounting of a powder applicator nozzle.
FIG. 5 is an enlarged vertical sectional view taken generally along the line 5—5 of FIG. 2, and shows the specifics of the powder applicator portion of the device.

Referring now to the drawings in detail, it will be seen that the powder applicator, which is the subject of this invention, is generally illustrated in FIG. 1 and is identified by the reference numeral 10. It is to be understood that the powder applicator 10 is particularly adapted for applying an electrostatically charged powder to a grounded metal can body in the form of an elongated stripe for the purpose of coating the side seam area of can bodies. Most particularly, these can bodies have welded side seams. In a conventional side seam welder, the can bodies are guided relative to a supporting horn, and that supporting horn carries an internal roller electrode. The details of this roller electrode are not illustrated here. However, it is to be understood that the horn which supports the welding apparatus also carries a supporting horn 11 which is the main support for the powder applicator 10. The details of the horn 11 and the manner in which it is supported by the welding horn in no way forms a part of this invention and will not be described further here.

The supporting horn 11 is preferably formed of an insulating material and includes an upper part 12 and a lower closure part 13 which are suitably secured together at spaced intervals by fasteners such as the fasteners 14 illustrated in FIG. 5. The two parts 12, 13 of the horn 11 are of such cross sections so as to provide internal cavities within the horn 11.

In accordance with this invention, powder to be applied to can body side seams is directed by a powder supply device 15 through a metering device 16 into a powder supply line 17 which enters the horn 11 from one end. As is best shown in FIGS. 2 and 3, the powder supply line 17 has an intermediate portion in the form of a centrifuge 18 which will not be described in detail here, but is so constructed wherein it separates the powder from its gas carrier with the powder being disposed in the upper portion of the powder supply line.

The powder applicator 10 also includes a nozzle 20 which is mounted within the horn in the manner best shown in FIG. 4. The nozzle 20 includes a nozzle head 21 which is pivotally mounted on a pin 22 carried by a U-shaped support 23. The support 23 is mounted within a cavity of the horn 11 by means of fasteners 24. The nozzle head 21 is adjustable about the pin 22 by means of a pair of positioning screws 25. It is to be noted that the nozzle 20 is adjusted so as to direct powder longitudinally of the horn 11 and slightly vertically so that the powder is directed onto side seams of can bodies passing over the horn 11 and such powder will impinge upon the can body interiors independent of any electrostatic charging of the powder.

The powder applicator 10 includes a powder applying portion 26 which is located downstream of the nozzle 20 and which is best illustrated in FIG. 5. The upper portion 12 of the horn 11 has the upper central part thereof of a cross section to define opposed seats 27 on opposite sides and above a plenum 28. The lower portion 13 of the horn is configurated to define a cavity 30 for receiving the electrical fittings of charging pins to be described hereinafter, and also functions as an air duct. The plenum 28 is joined to the air duct 30 by a plurality of passages 31 so that air or other gas is evenly supplied to the plenum 28 along its length.

In accordance with this invention, a block 32 of porous material is seated in the upper part of the upper portion 12 of the horn on the seats 27. The block 32 is preferably of an elongated one-piece construction and is slidable into the horn upper portion 12 from the right end thereof. The opposed seats 27 provide for a firm interlock of the block 32 with the horn 11 so that shifting of the block 32 is prevented. At the same time the block 32 closes the upper end of the plenum 28 in sealed relation so that air escaping from the plenum 28 must pass through the porous block 32.

The porous block 32 has formed in the upper surface thereof a longitudinally extending channel 33 which is of a truncated V-shaped cross section, the channel 33 having a narrow flat bottom 34. The cross section of the channel 33 is one wherein there is little tendency for localized build-up of powder which does not initially adhere to the can bodies which are being striped.

In order that the powder which does not initially adhere to the can bodies and which falls back into the channel 33 may again be electrostatically charged and attracted to the can bodies, there is provided a plurality of charging pins 35. Each charging pin 35 is primarily supported by the supporting horn upper portion 12, as is best shown in FIG. 5. However, each charging pin 35 does extend through the porous block 32 and has an upper tip portion disposed within the channel 33 and projecting a short distance above the bottom 34.

In order to confine that area of each can body which is exposed to the application of powder, the upper part of the horn 11 carries a pair of vertically disposed, parallel brushes 36 which are intended sealingly to engage the interior of a can body. Each brush 36 is seated in a vertical recess 37 in the horn 11 and is releasably retained in place by a plurality of set screws 38.

Figure 6:
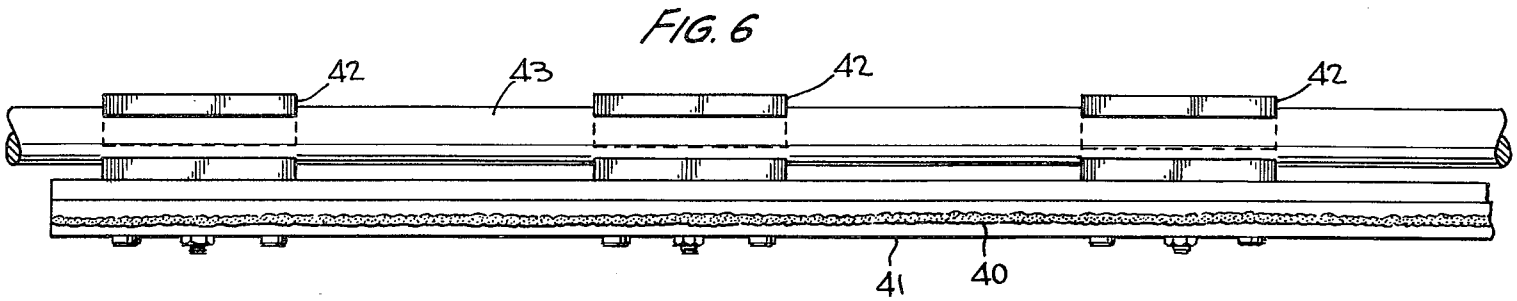
FIG. 6 is a longitudinal sectional view taken generally along the line 6—6 of FIG. 5, and shows the mounting of a grounding brush.

In order that the can bodies may be grounded during the application of powder to the side seams thereof, there is also provided a grounding brush 40 which engages the exterior of each can body in electrically conducting relation. The grounding brush is carried by a bracket 41 which, in turn, is carried by longitudinally spaced supports 42, as is best shown in FIG. 6. Each support 42 is of a multiple-piece construction so as to be clampable on a support rod 43.

With respect to the brushes 36 and 40, it is to be understood that the powder applicator 10 is intended to be utilized in conjunction with can bodies of different sizes. Most particularly, the powder applicator 10 is intended to be utilized with can bodies of the 2 2/16 inches and 2 11/16 inches diameter sizes. The can bodies, which are identified by the reference letter C, will be suitably supported by guide means (not shown) which are adjustable or replaceable to accommodate a specific size of can body. The brushes 36, which are preferably formed of a fibrous material, may be trimmed to the proper height for the selected can body size. The brushes 40 may be rotationally adjusted relative to the support rod 43.

At this time it is pointed out that the can bodies C are moved along a preselected path by means of a suitable conveyor 44 as is shown in FIGS. 1 and 5.

Figure 8:
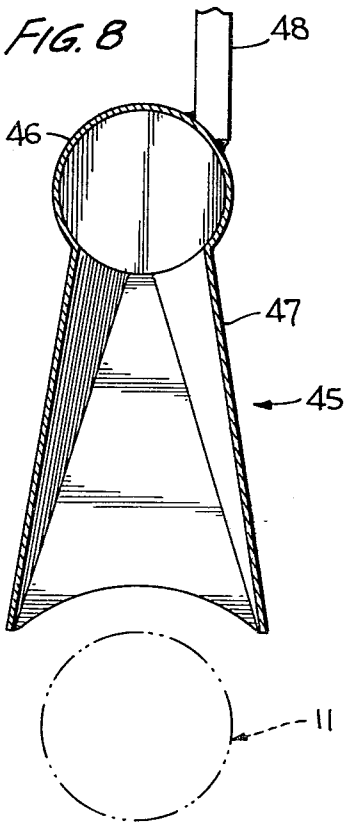
FIG. 8 is a transverse vertical sectional view taken generally along the line 8—8 of FIG. 7, and shows further the details of the overspray duct.
Figure 7:
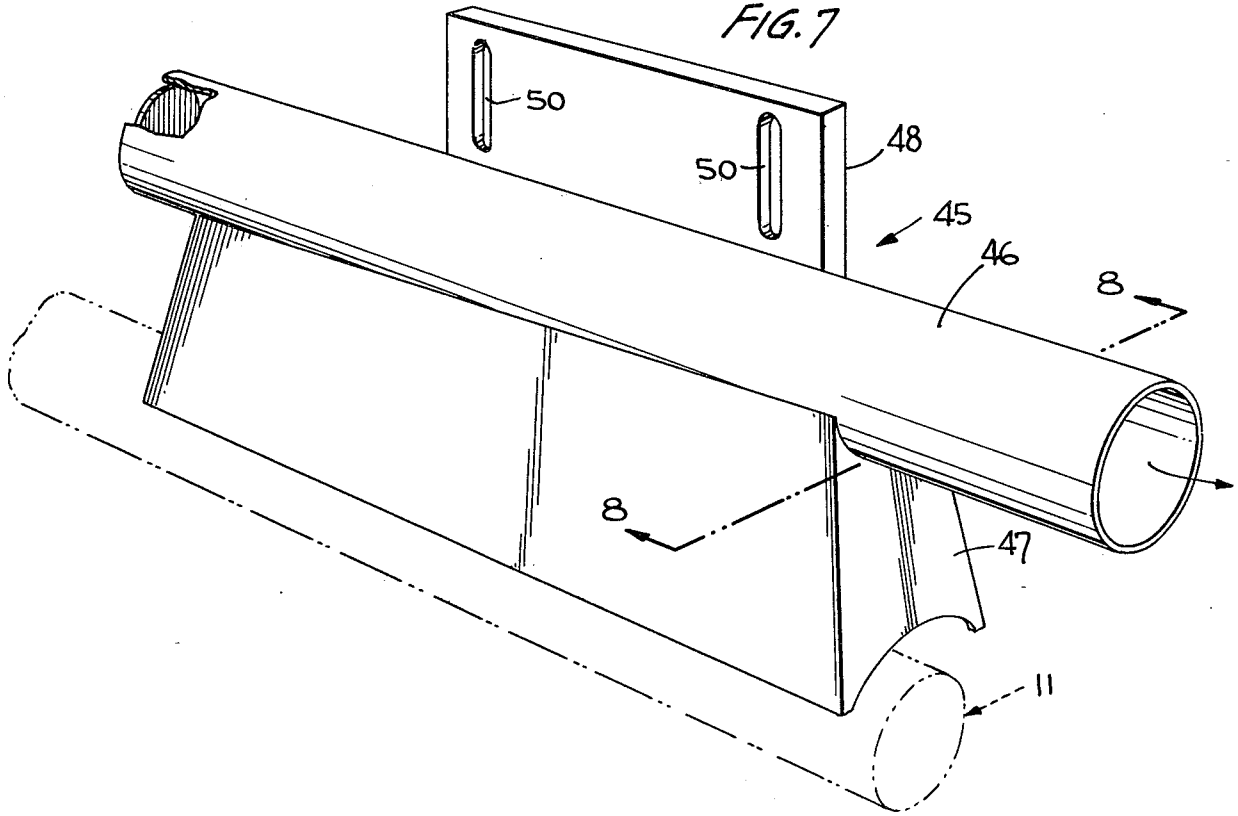
FIG. 7 is a perspective view showing the details of a powder overspray duct.

The applicator 10 also includes an overspray collector, generally identified by the numeral 45. The overspray collector 45 includes a vacuum pipe 46 which has depending therefrom a suitable hood 47. The hood 47 is of a tapered configuration, as shown in FIG. 8, and has the upper part thereof opening into the vacuum pipe or duct 46. The lower part of the hood 47 is of a width greater than the width of the intended can bodies and is configurated to clear all diameters of can bodies for which the applicator 10 is intended.

The overspray hood is mounted independently of the horn 11 by means of a suitable support bracket 48. It is to be understood that the hood may be vertically adjusted utilizing the elongated slots 50 in the support bracket 48, and that the hood 47 extends the full length of the block 32 and beyond opposite ends thereof as is shown in FIG. 1.

The apparatus includes a high voltage generator 51 which is suitably coupled to the powder supply apparatus for initially electrostatically charging the powder. The generator 51 is also coupled to the charging pins 35 for effecting the charging thereof.

In accordance with this invention, there is a single duct 52 which serves the function of both supplying air or other gas under pressure into the chamber 30 and for carrying a lead wire 53 leading to the charging pins 35. The air or other gas entering into the chamber 30 is directed into the plenum 28 and up through the porous block 32 so that any powder having a tendency to settle on the bottom 34 of the channel 33 will be agitated generally to form a cloud of such powder. Thus, the powder is prevented from building up on the bottom wall 34.

The powder applicator 10 includes one further important feature in the form of a deflector block 54 which is seated in the terminal end of the channel 33 and which has a sloping upper surface 55 which directs any powder which reaches the terminal end of the channel 33 vertically up out of the channel 33 and out of the powder applicator. This minute amount of powder will be directed between adjacent can bodies into the overspray collector or hood 45 and returned to the powder supply. At this time it is pointed out that the application of powder is continuous and when there is no can body directly aligned with the nozzle 20, sprayed powder will pass between adjacent can bodies and be received in the collector 45. Thus, the primary function of the collector 45 is to collect overspray, but in the same manner it will collect excess powder from the channel 33.

OPERATION

In operation, can bodies C which have newly formed welded side seams 56 located at the 12:00 o'clock position will pass onto the supporting horn 11 in closely adjacent, but spaced, relation. Electrostatically charged coating powder will then be sprayed onto the general area of the side seam 56 in the interior of the can body to form a coating stripe which, either due to the heat from the welding operation or by way of subsequent heaters, will become melted and will flow to form a unitary coating stripe. The powder, being initially electrostatically charged and the can bodies being grounded, will be primarily attracted to the can body and will remain in place where initially deposited. However, small amounts of the powder will not adhere to the can body when first applied and will bounce off and will be deposited in the channel 33. This additional powder will be constantly circulated by the air or other gas passing through the porous block 32 into the channel 33 and will be once again electrostatically charged by way of the charging pins 35 so as to be attracted to the can body.

The flow of the powder through the nozzle 20 is regulated so that there is substantially no excess powder over and above that which will be retained on the can body side seam area by way of the electrostatic charging. Thus, by constantly circulating the deflected powder and recharging the same, the deflected powder will substantially all be returned to and adhered to the can body side seam areas.

That minute amount of powder which is not truly excess powder but powder which did not have an opportunity to adhere to the can body side seam areas will be deflected out of the channel 33 in the terminal end thereof between adjacent can bodies and into the overspray collector 45 so that there will be no build-up of powder within the channel 33 which would eventually require stoppage of the body line.

Although only a preferred embodiment of the invention has been specifically illustrated and described herein, minor variations may be made in the powder applicator without departing from the spirit and scope of the invention as defined by the appended claims.

What is claimed as new is:

1. A powder applicator for applying a coating stripe to the exterior of a longitudinal side seam of a tubular body moving along a tubular path and wherein said side seam is generally at the 12:00 o'clock position, said powder applicator comprising a supporting horn, longitudinally extending upwardly directed brushes carried by upper portions of said horn in transversely spaced relation and generally equally spaced on opposite sides of a vertical plane through a longitudinal axis of said horn, said brushes being positioned for engagement with the interior of a tubular body adjacent to said side seam thereof to limit the width of said coating stripe, feed means adjacent said horn for sequentially moving tubular bodies along said horn in closely spaced relation, and powder flow control means in an upper part of said horn and generally between said brushes, said powder flow control means including an elongated longitudinally extending channel defined by porous wall means, a powder applying nozzle opening into one end of said channel generally in the direction of tubular body movement, said nozzle being tilted slightly vertically for directing coating powder directly on a tubular body side seam area between said brushes, means for electrostatically charging said powder delivered to said nozzle for effecting initial adherence of a majority of the coating powder directly to tubular bodies with said channel forming catcher means for powder not initially adhering to tubular bodies, charging means in said channel for charging powder falling in said channel and again directing such powder upwardly towards said path of tubular body movement for application to tubular bodies, means for directing a gas through said wall means for continuously agitating powder within said channel, diverter means in said channel at the end thereof remote from said one end for directing powder reaching said channel remote end vertically out of said channel towards the path.

2. A powder applicator according to claim 1 wherein said channel is of a truncated V-shaped cross section including a flat bottom wherein powder build-up in said channel is minimal.

3. A powder applicator according to claim 1 wherein said wall means defining said channel are defined by a single elongated block, and said horn has a channel therein of a shape seating said block for longitudinal displacement only.

4. A powder applicator according to claim 1 wherein said wall means defining said channel are defined by a single elongated block, said channel is of a truncated V-shaped cross section including a flat bottom wherein powder build-up in said channel is minimal.

5. A powder applicator according to claim 4 wherein said charging means in said channel is in the form of a longitudinal row of spaced upright charging pins.

6. A powder applicator according to claim 5 wherein said horn defines below said block a gas supply channel, said charging pins extend through said porous block into said gas supply channel, and electrical power supply means for said charging pins are disposed within said gas supply channel and coupled to said charging pins therein.

7. A powder applicator according to claim 4 wherein said horn defines below said block a gas supply channel, said charging pins extend through said porous block into said gas supply channel, and electrical power supply means for said charging pins are disposed within said gas supply channel and coupled to said charging pins therein.

8. A powder applicator for applying a coating stripe to the exterior of a longitudinal side seam of a tubular body moving along a tubular path and wherein said side seam is generally at the 12:00 o'clock position, said powder applicator comprising a supporting horn, longitudinally extending upwardly directed brushes carried by upper portions of said horn in transversely spaced relation and generally equally spaced on opposite sides of a vertical plane through a longitudinal axis of said horn, said brushes being positioned for engagement with the interior of a tubular body adjacent to said side seam thereof to limit the width of said coating stripe, feed means adjacent said horn for sequentially moving tubular bodies along said horn in closely spaced relation, and powder flow control means in an upper part of said horn and generally between said brushes, said powder flow control means including an elongated longitudinally extending channel defined by porous wall means, a powder applying nozzle opening into one end of said channel generally in the direction of tubular body movement, said nozzle being tilted slightly vertically for directing coating powder directly on a tubular body side seam area between said brushes, means for electrostatically charging said powder delivered to said nozzle for effecting initial adherence of a majority of the coating powder directly to tubular bodies with said channel forming catcher means for powder not initially adhering to tubular bodies, charging means in said channel for charging powder falling in said channel and again directing such powder upwardly towards said path of tubular body movement for application to tubular bodies, means for directing a gas through said wall means for continuously agitating powder within said channel, said channel being of a truncated V-shaped cross section including a flat bottom wherein powder build-up on said bottom is minimal.

9. A powder applicator according to claim 8 wherein said wall means defining said channel are defined by a single elongated block.

10. A powder applicator according to claim 9 wherein in said horn defines below said block a gas supply channel, said charging pins extend through said porous block into said gas supply channel, and electrical power supply means for said charging pins are disposed within said gas supply channel and coupled to said charging pins therein.

11. A powder applicator according to claim 9 wherein said charging means in said channel is in the form of a longitudinal row of spaced upright charging pins.

12. A powder applicator according to claim 8 wherein said wall means defining said channel are defined by a single elongated block, and said horn has a channel therein of a shape seating said block for longitudinal displacement only.

* * * * *